US005901727A

United States Patent [19]

Kramer et al.

[11] Patent Number: 5,901,727

[45] Date of Patent: May 11, 1999

[54] TENT INCLUDING WEB STRUCTURE AND ARTICLE STORAGE AND SUPPORT MEMBER

[75] Inventors: Paul Frederick Kramer, Berkeley; Martin S. Zemitis, Davis, both of Calif.

[73] Assignee: Mountain Hardwear, Inc., Berkeley, Calif.

[21] Appl. No.: 08/878,417

[22] Filed: Jun. 18, 1997

[51] Int. Cl.[6] ..... E04H 15/40

[52] U.S. Cl. ..... 135/136; 135/124; 135/125; 135/128; 135/138; 135/120.1; 135/120.3; 135/161

[58] Field of Search ..... 135/124, 125, 135/128, 138, 120.1, 120.3, 161, 136

[56] References Cited

U.S. PATENT DOCUMENTS

| | | | |
|---|---|---|---|
| 985,002 | 2/1911 | Brown . | |
| 1,124,263 | 1/1915 | Bemis . | |
| 1,531,622 | 3/1925 | Parsons . | |
| 2,197,791 | 4/1940 | Eddy . | |
| 2,511,974 | 6/1950 | Finken et al. . | |
| 2,619,101 | 11/1952 | McGerry et al. . | |
| 2,693,195 | 11/1954 | Frieder et al. . | |
| 2,802,478 | 8/1957 | Fritsche . | |
| 3,182,672 | 5/1965 | Biller, Jr. . | |
| 3,406,698 | 10/1968 | Hutchison . | |
| 3,703,181 | 11/1972 | Tholen . | |
| 3,909,993 | 10/1975 | Huddle | 135/124 X |
| 3,986,519 | 10/1976 | Gillis . | |
| 4,099,533 | 7/1978 | Gillis . | |
| 4,192,333 | 3/1980 | Sato | 135/124 |
| 5,197,504 | 3/1993 | Howe . | |
| 5,301,705 | 4/1994 | Zheng | 135/125 X |
| 5,396,917 | 3/1995 | Hazinski et al. | 135/125 |

FOREIGN PATENT DOCUMENTS

| | | | |
|---|---|---|---|
| 1264328 | 2/1972 | United Kingdom . | |
| 2224759 | 5/1990 | United Kingdom | 135/125 |

OTHER PUBLICATIONS

REI Camping '96 Catalog, p. 103 Sierra Designs 1989 Brochure page describing "Portable Attic".

Sierra Designs 1978 Catalog pp. 5–8 describing "Aireflex" and "Octadome" tent designs.

1982 Sierra Design Poster.

*Primary Examiner*—Christopher Kent
*Assistant Examiner*—Yvonne Horton-Richardson
*Attorney, Agent, or Firm*—Thomas R. Lampe

[57] ABSTRACT

Tent structure includes a canopy formed of flexible sheet material. Poles are employed to support the canopy to form a tent interior. A web structure is attached to the canopy and formed of flexible sheet material. The web structure is maintained under tension when the canopy is supported. An article storage and support member formed of flexible sheet material is attached to the web structure within the tent interior and maintained under tension.

14 Claims, 17 Drawing Sheets

TENT INCLUDING WEB STRUCTURE AND ARTICLE STORAGE AND SUPPORT MEMBER

TECHNICAL FIELD

This invention relates to a tent. More particularly, the invention relates to tent structure which is highly stable when assembled and which has article storage capacity within the interior of the tent.

BACKGROUND OF THE INVENTION

Many different tent configurations and structures are in existence, including tents having a dome-like structure formed from a canopy of fabric or other sheet or sheet-like material supported by bent support rods or poles connected to the canopy. Such rods are typically formed of a material which is relatively rigid and yet permits flexing. The rods, when flexed in arch form during assembly, cooperate with the canopy to provide the desired configuration of the tent.

Dome-type tents are not always as stable as one might wish, especially when subjected to external forces such as those produced by high winds. Furthermore, internal storage space is usually minimal in such structures.

The tent of the present invention incorporates structure which performs the dual function of adding strength and stability to the tent and adding article storage capacity inside the tent.

While it is known to incorporate pouches and shelves per se in tents, none of the known prior art arrangements provide the dual advantages of the present invention in a single structural combination.

The following United States patents are believed to be representative of the current state of the prior art in this area: U.S. Pat. No. 3,986,519, issued Oct. 19, 1976, U.S. Pat. No. 4,099,533, issued Jul. 11, 1978, U.S. Pat. No. 5,197,504, issued Mar. 30, 1993, U.S. Pat. No. 3,703,181, issued Nov. 21, 1972, U.S. Pat. No. 3,406,698, issued Oct. 22, 1968, U.S. Pat. No. 3,182,672, issued May 11, 1965, U.S. Pat. No. 2,802,478, issued Aug. 13, 1957, U.S. Pat. No. 2,511,974, issued Jun. 20, 1950, U.S. Pat. No. 2,197,791, issued Apr. 23, 1940, U.S. Pat. No. 1,51,622, issued Mar. 31, 1925, U.S. Pat. No. 1,124,263, issued Jan. 12, 1915, U.S. Pat. No. 985,002, issued Feb. 21, 1911, British Patent Specification No. 1,264,328, published Feb. 23, 1972, and U.S. Pat. No. 2,693,195, issued Nov. 2, 1954.

Pages 5–8 of the Sierra Designs 1978 Catalog illustrates tent designs which utilize an arched pole connected at its lower ends by a tension member in the form of a panel extending between the leg of the arch which allegedly reinforces the arch and increases its load-bearing capacity. The same feature is described in a 1982 Sierra Designs poster. Such feature does not appear to add any interior article storage capacity in the tent interior whatsoever.

Representative types of pouches, shelves or holders employed within dome-type or other tents are also shown on page 103 of the REI Camping '96 catalog and in a 1989 Sierra Designs brochure describing a "portable attic" releasably attached to a tent and hanging therefrom. So-called gear lofts or attics do not appear to contribute in a meaningful way to the overall structural stability of the tent. Hanging pockets or pouches have been used in tent structures but they are often of a structurally unstable character and have relatively limited capacity, often being essentially planar in configuration. Considerable sagging of pocket structure often takes place in prior art constructions and such pockets do not add to the strength or stability of the tent.

DISCLOSURE OF INVENTION

The present invention relates to tent structure which is characterized by its stability and which also provides storage capacity for the user within the interior of the tent.

The tent employs a combination of web structure and an article storage and support member which are both formed of flexible sheet material and are employed in combination with one another and with a tent canopy. The web structure increases the strength and stability of the tent and cooperates with the article storage and support member to provide strong, stable means for storing articles within the tent interior. The article storage and support member can also contribute to the strength and stability of the overall tent structure. By employing such a structural combination in a tent, substantial storage space is created in a stable structural environment. Deformation under stored article load is minimized, allowing the tent occupant or occupants to temporarily store clothing and other gear in an elevated position and free up tent floor space.

Other features, advantages, and objects of the present invention will become apparent with reference to the following description and accompanying drawings.

MODES FOR CARRYING OUT THE INVENTION

Figure 1:
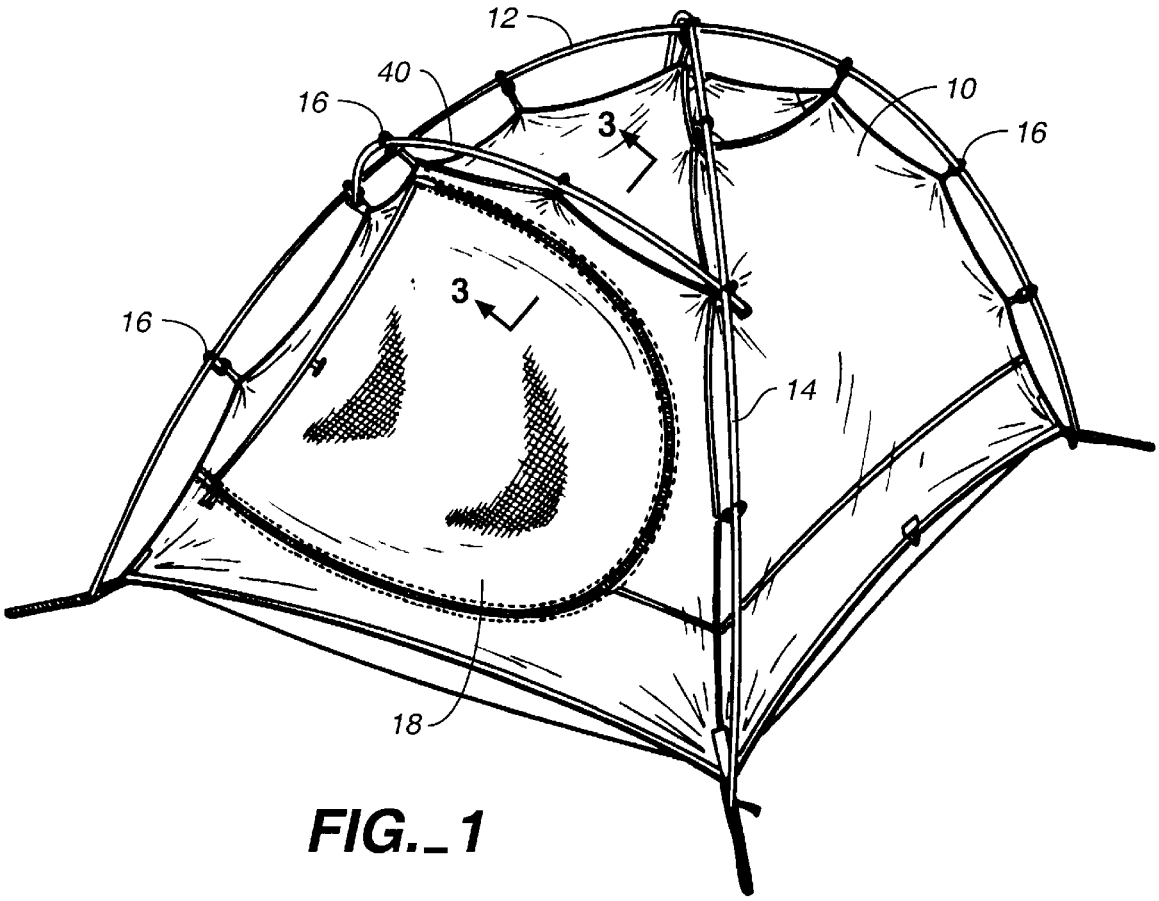
FIG. 1 is a frontal, perspective view illustrating a tent constructed in accordance with the teachings of the present invention.
Figure 2:
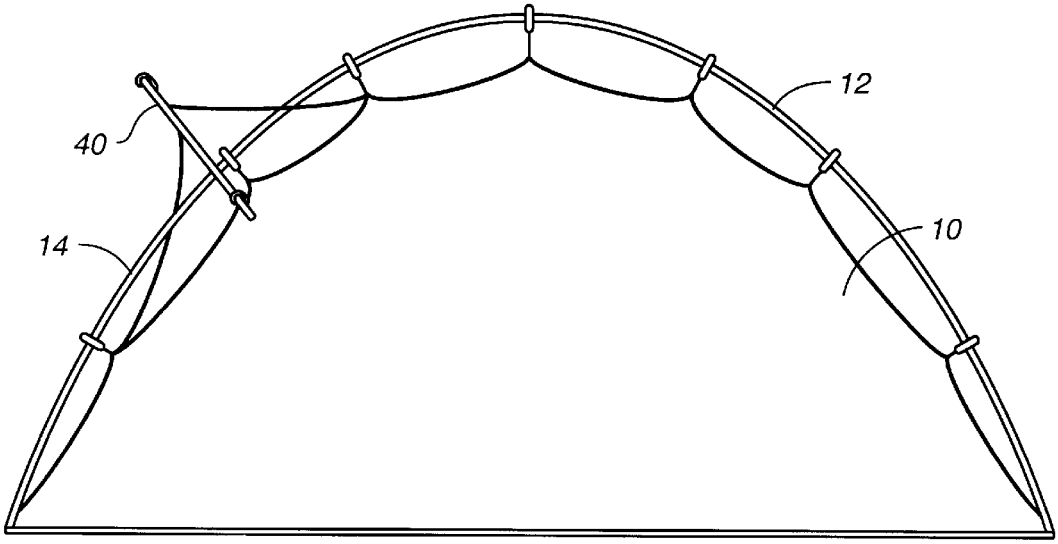
FIG. 2 is a somewhat diagrammatic, side view of the tent.
Figure 3:
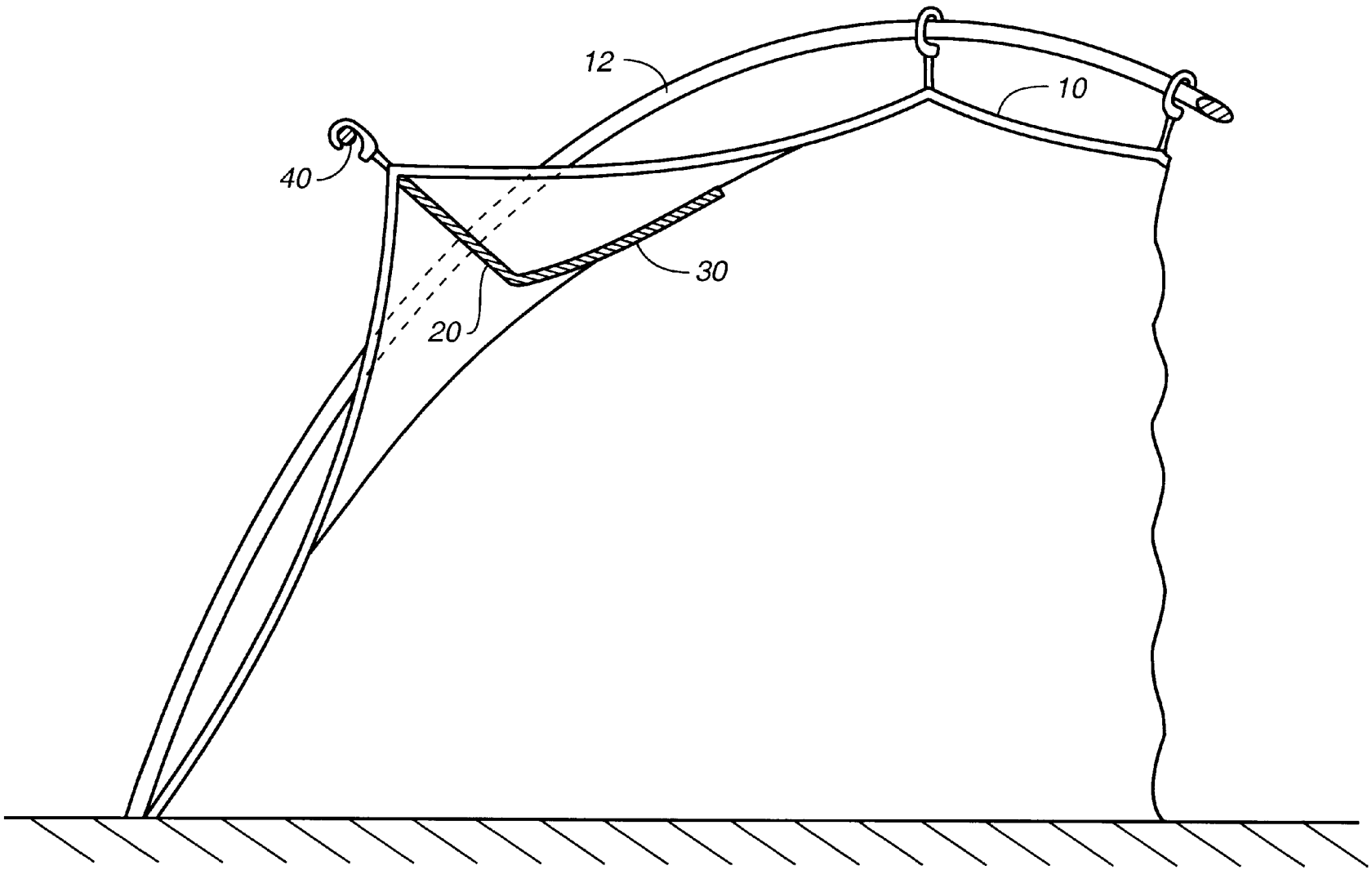
FIG. 3 is a partial, simplified cross-sectional view of the tent illustrating a portion of the interior thereof as defined by line 3—3 in FIG. 1 and a web structure and storage shelf within the tent interior.
Figure 4:
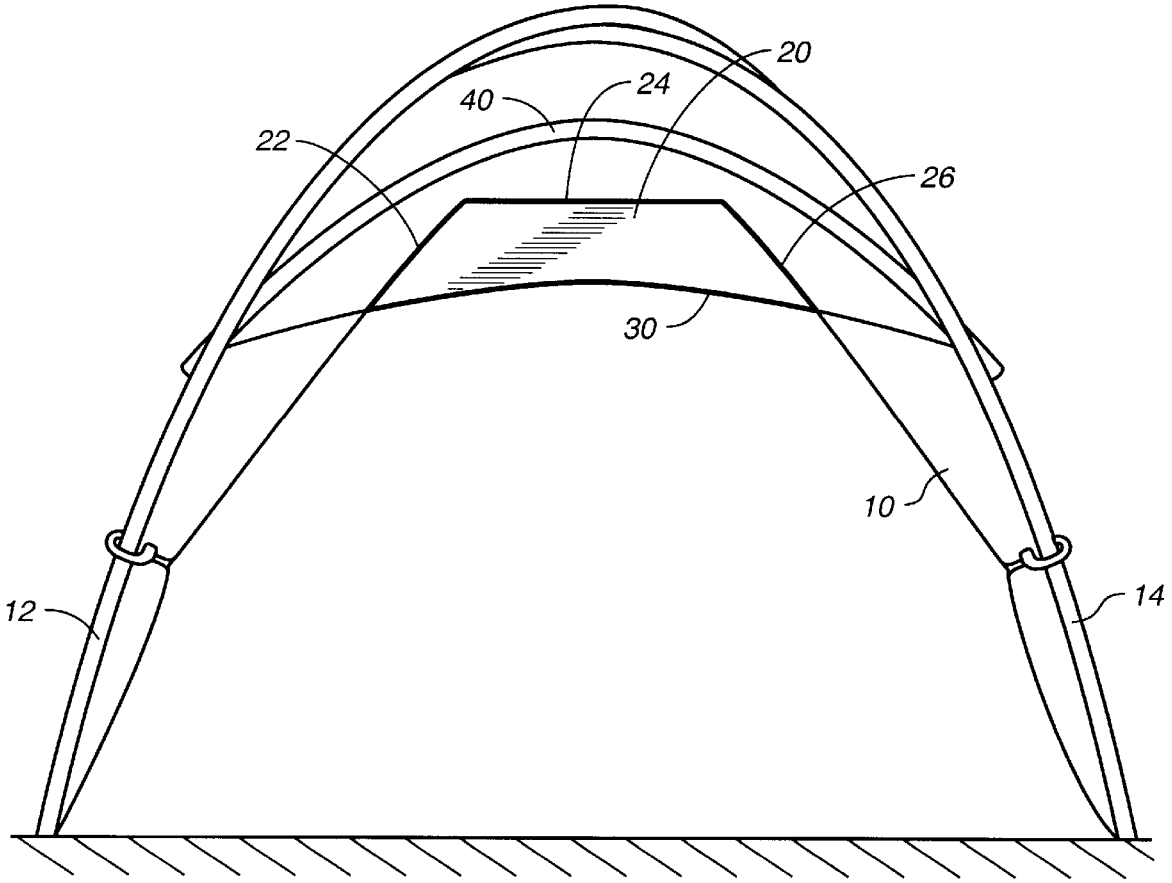
FIG. 4 is a somewhat schematic elevation view of the tent illustrating the web structure, storage shelf, and related structure.
Figure 5:
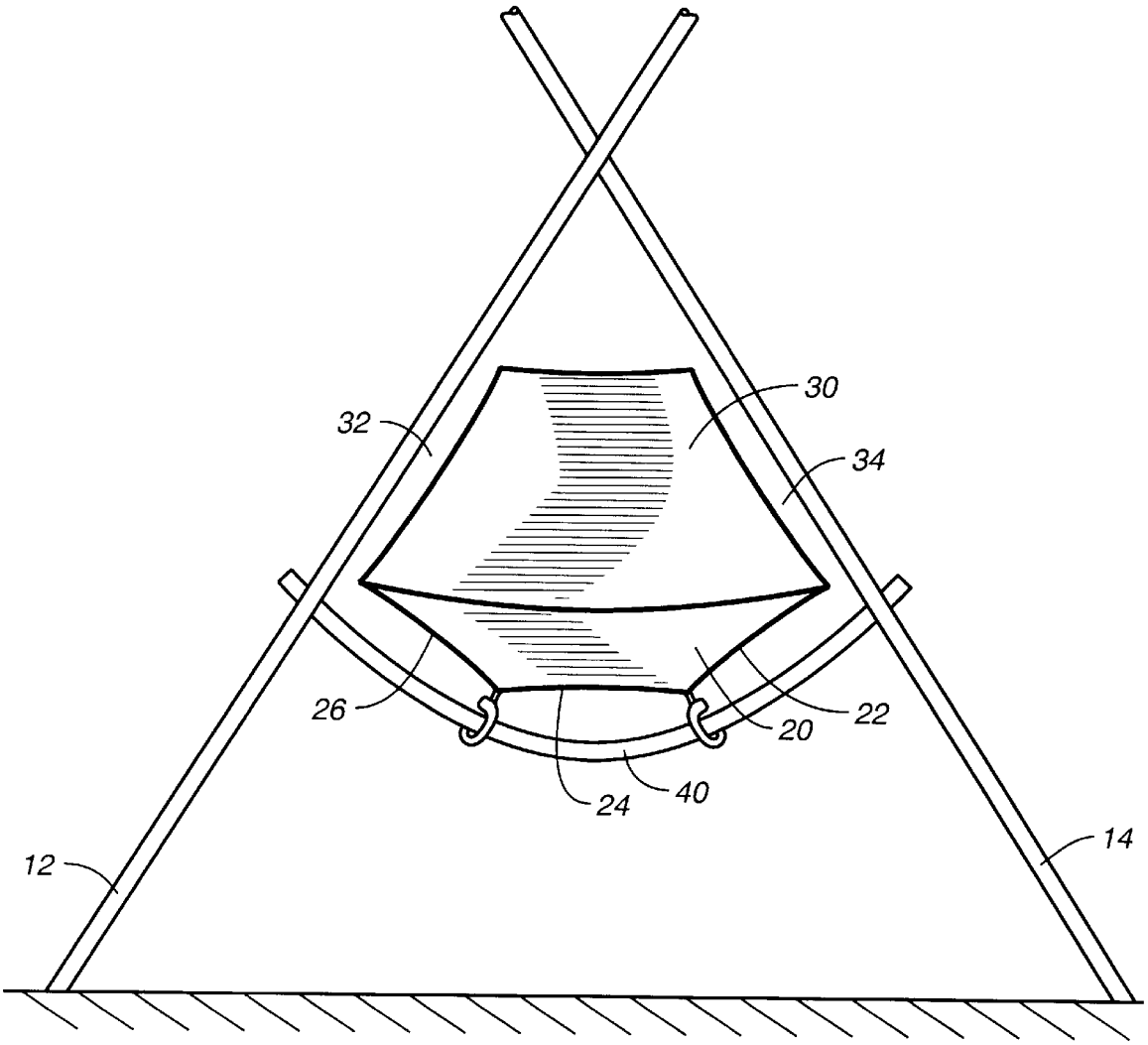
FIG. 5 is a top schematic view of a portion of the tent structure including two crossing support poles, the web structure and storage shelf combination, and a stabilizer pole extending between the support poles.
Figure 6:
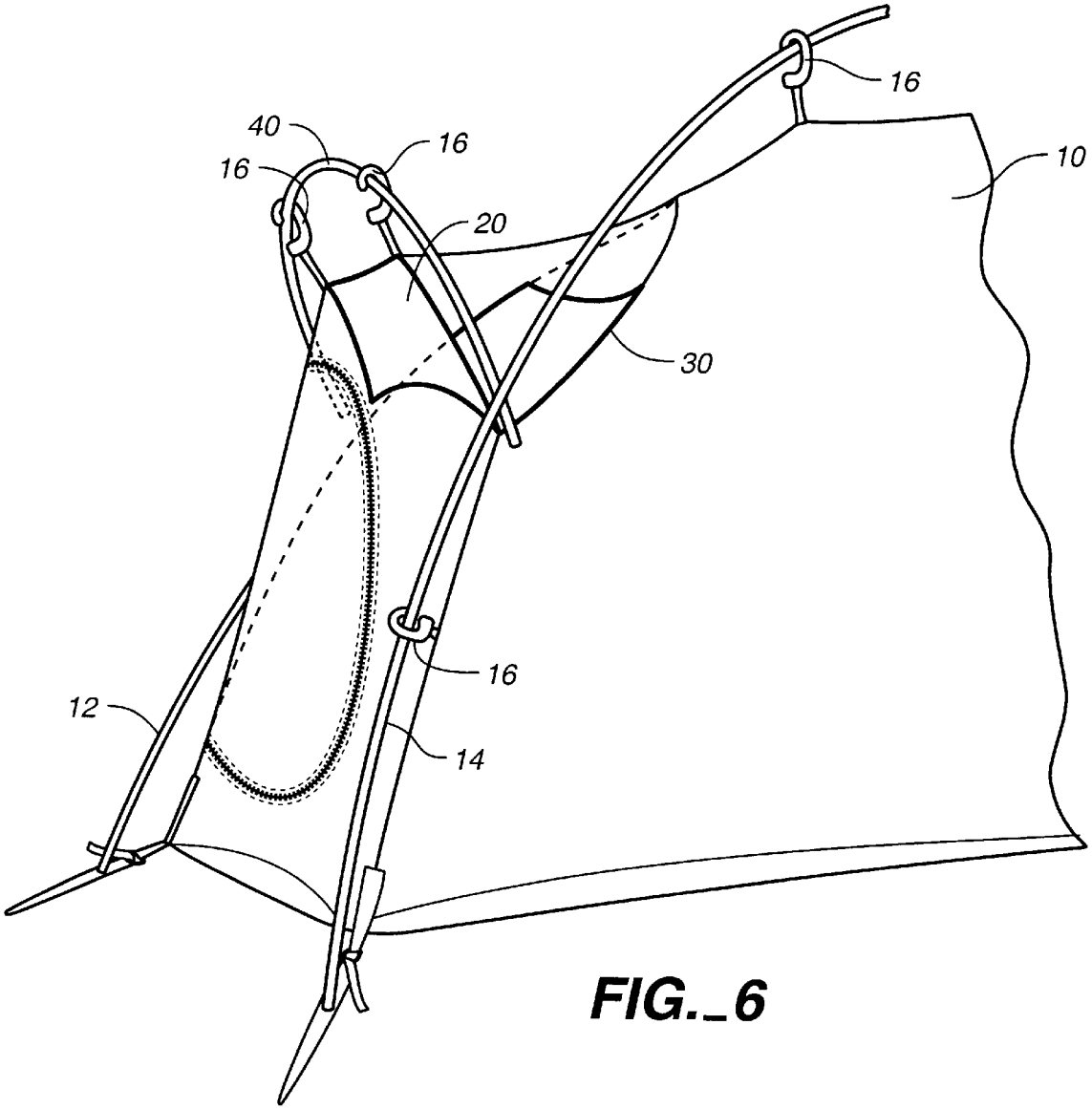
FIG. 6 is a schematic perspective view illustrating a selected portion of the tent structure.
Figure 7:
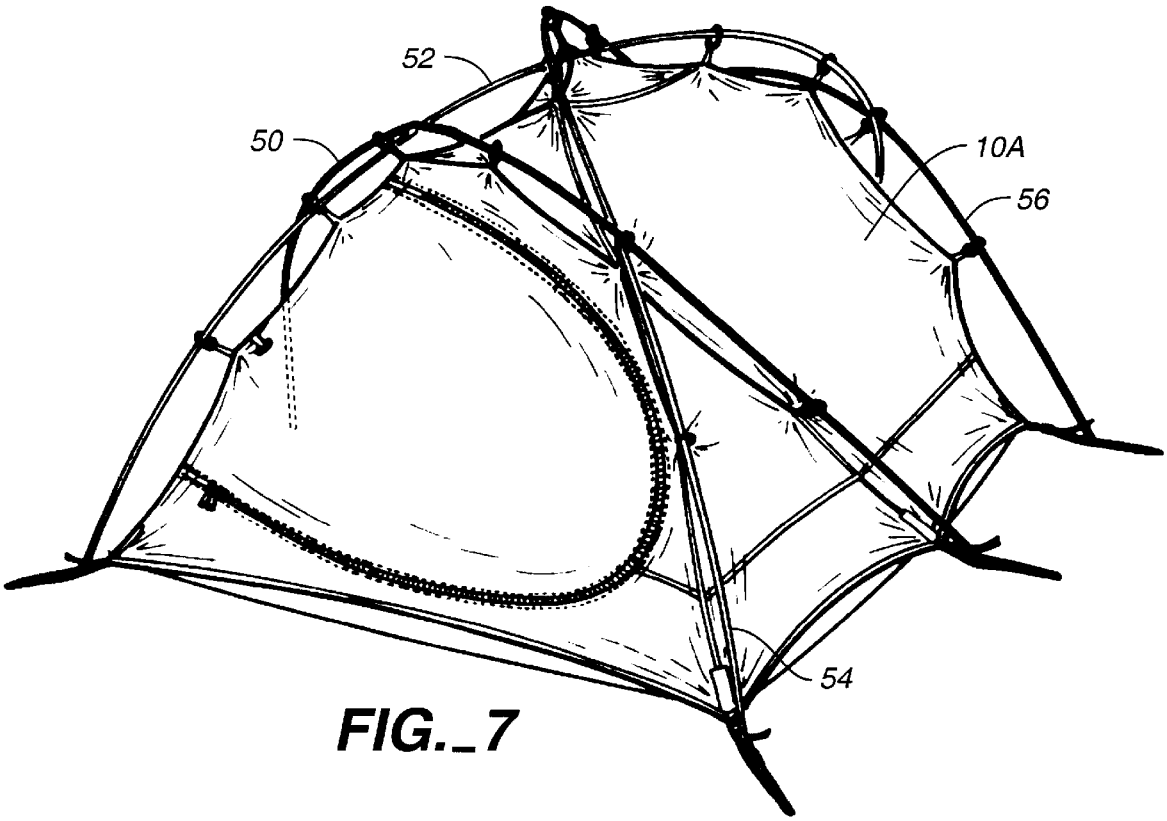
FIG. 7 is a view similar to FIG. 1, but illustrating an alternative embodiment of the invention.
Figure 8:
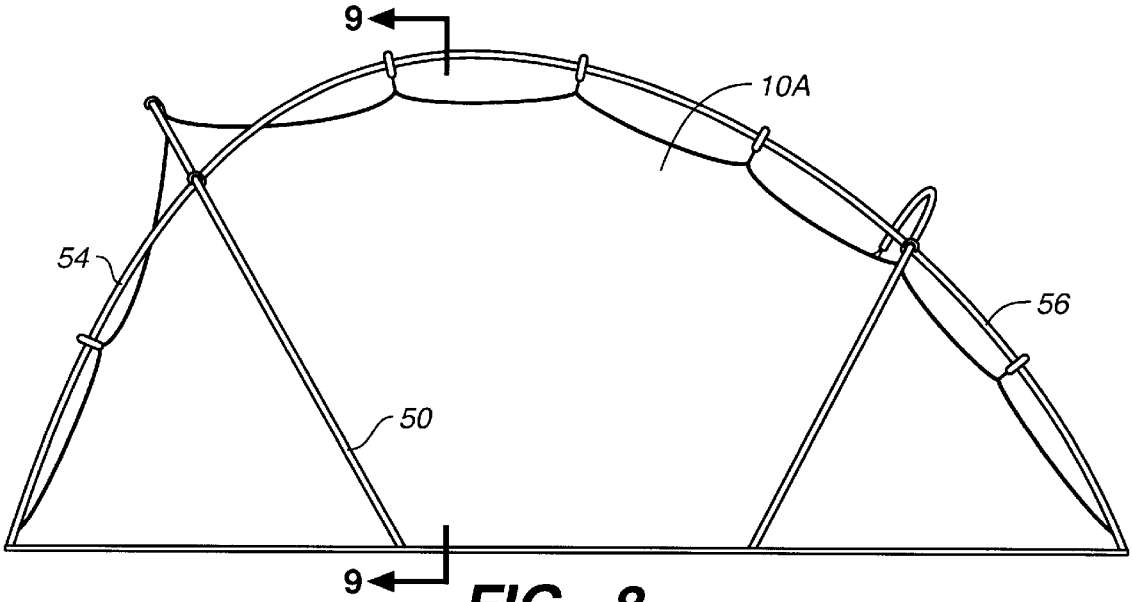
FIG. 8 is a view similar to FIG. 2, but illustrating the alternative embodiment.
Figure 9:
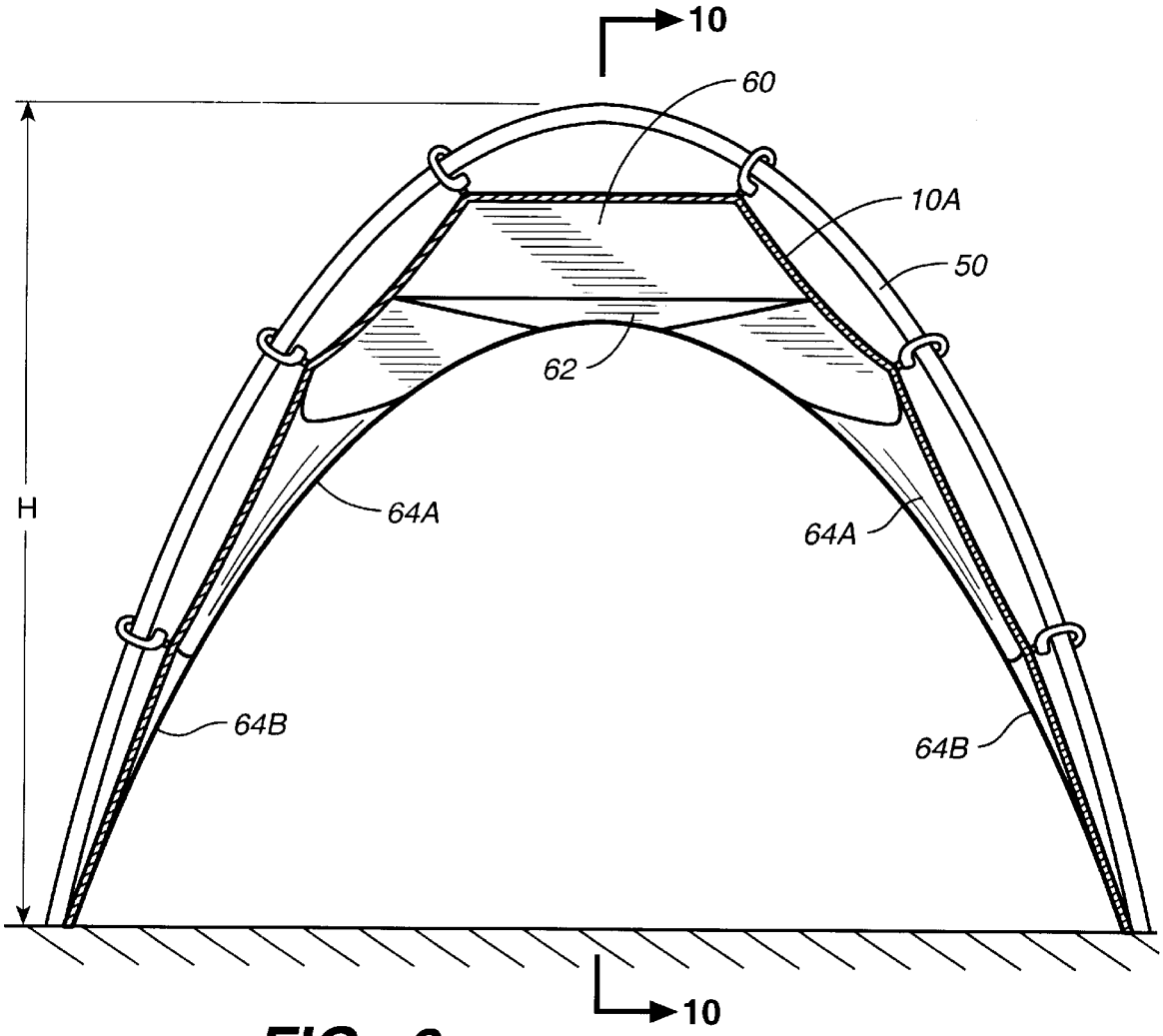
FIG. 9 is a cross-sectional elevational view illustrating the interior of the tent embodiment shown in FIG. 7 as taken along the line 9—9 in FIG. 8.
Figure 10:
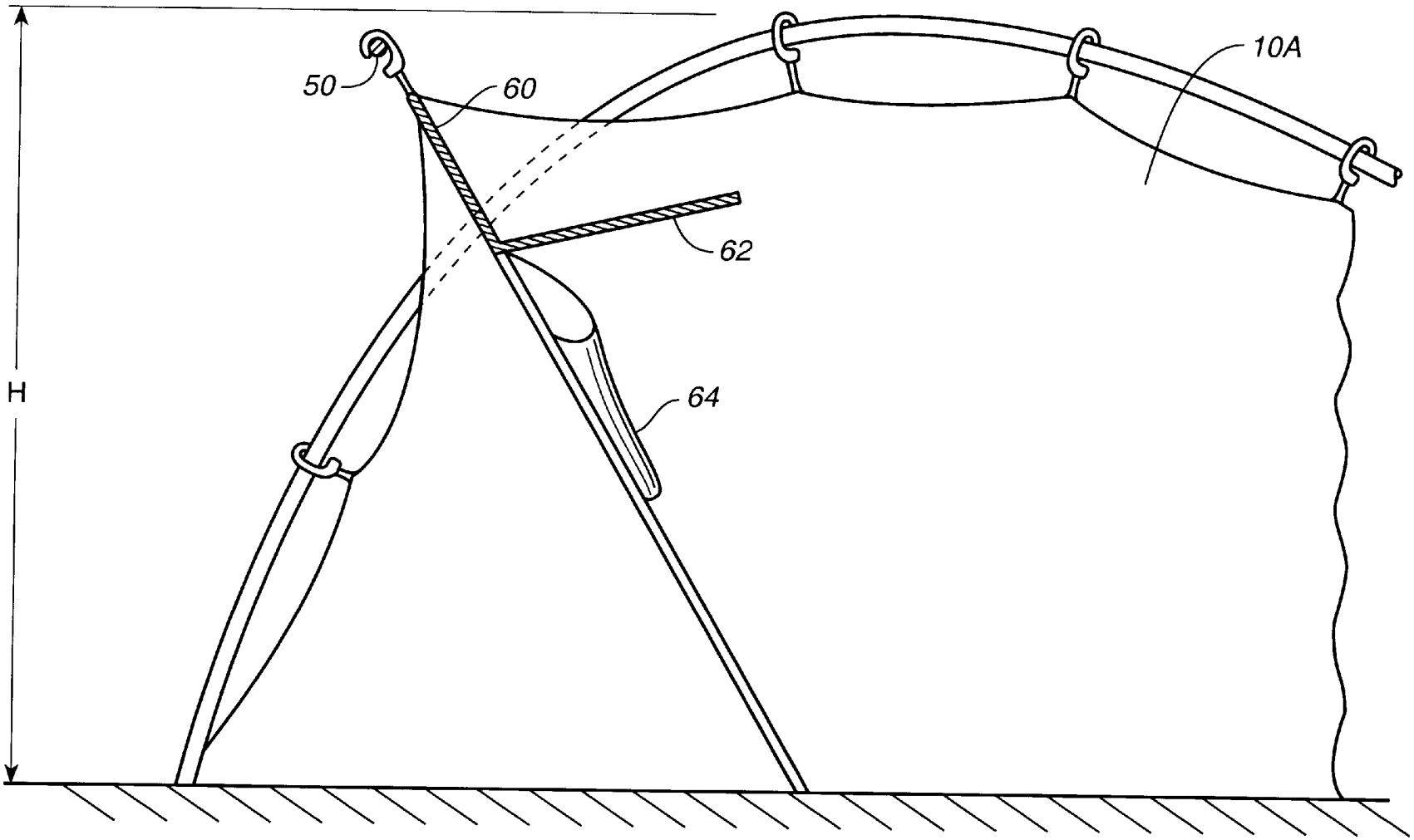
FIG. 10 is a view similar to FIG. 3 of the embodiment of the tent shown in FIG. 7 as taken along the line 10—10 in FIG. 9.
Figure 11:
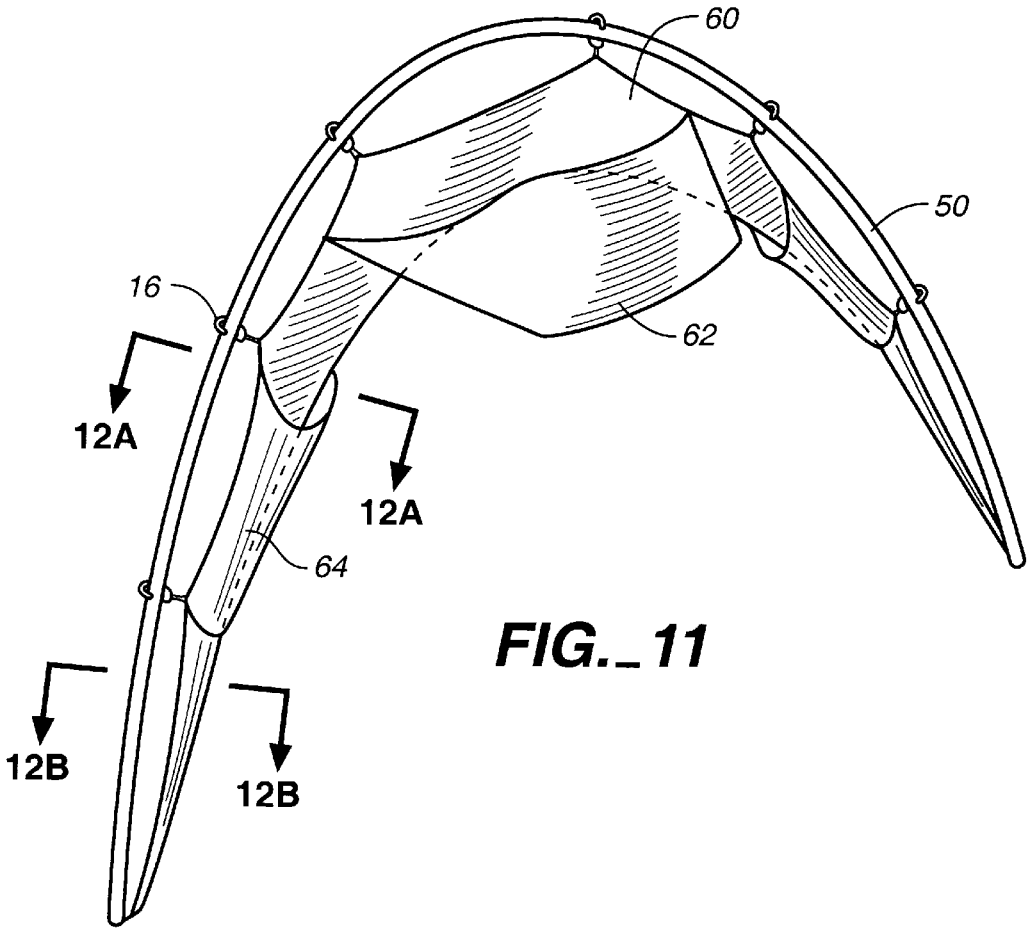
FIG. 11 is a perspective view of the structure shown in FIG. 9.
Figure 12A:
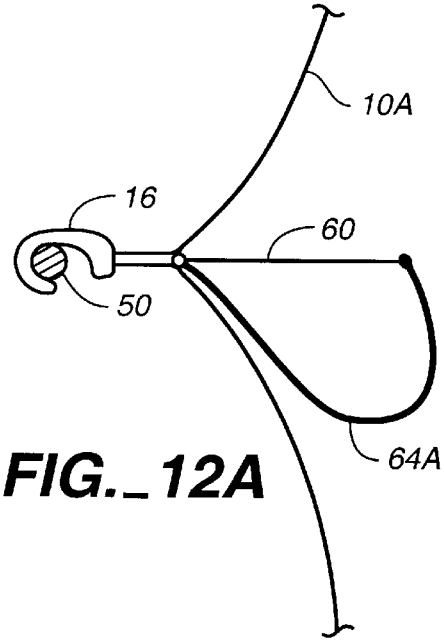
FIG. 12A is a somewhat diagrammatic cross-sectional view taken along the line 12A—12A in FIG. 11.
Figure 12B:
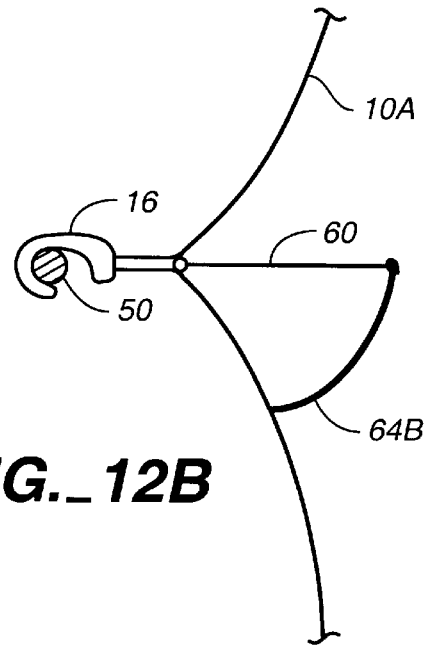
FIG. 12B is a somewhat diagrammatic cross-sectional view taken along the line 12B—12B in FIG. 11.
Figure 13:
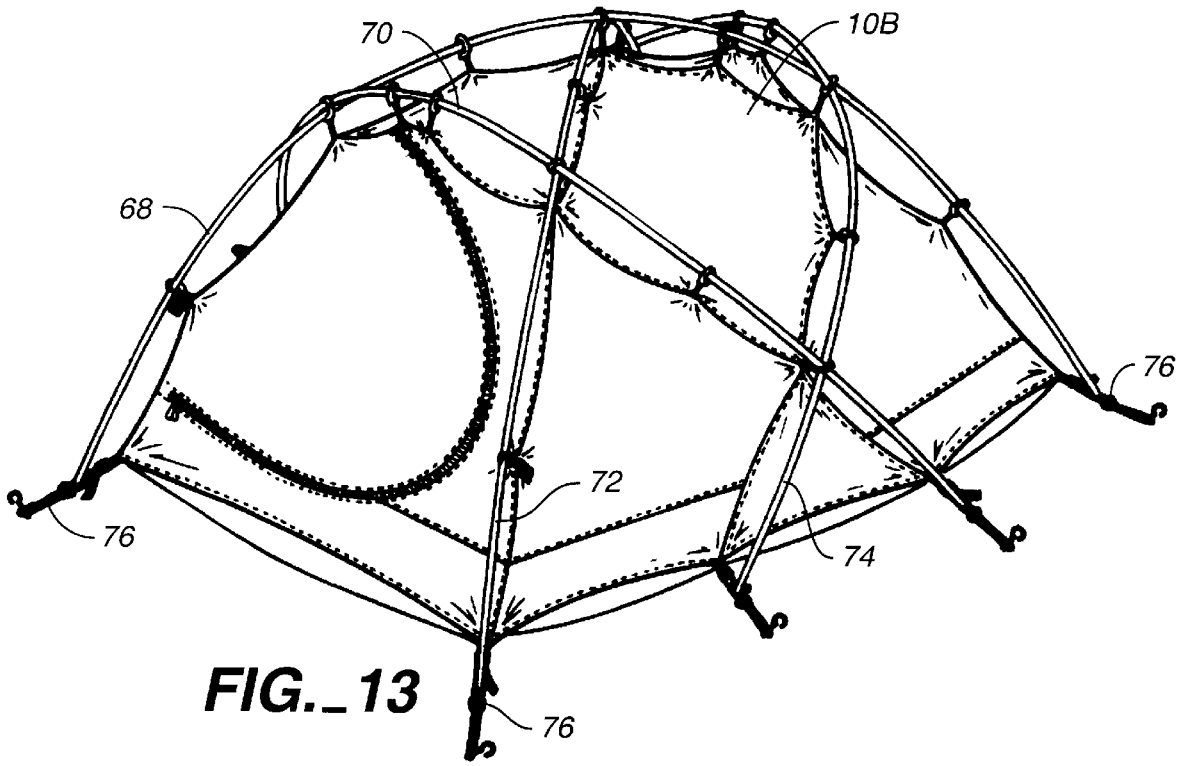
FIG. 13 is a view similar to FIG. 1, but illustrating another alternative embodiment of the invention.
Figure 14:
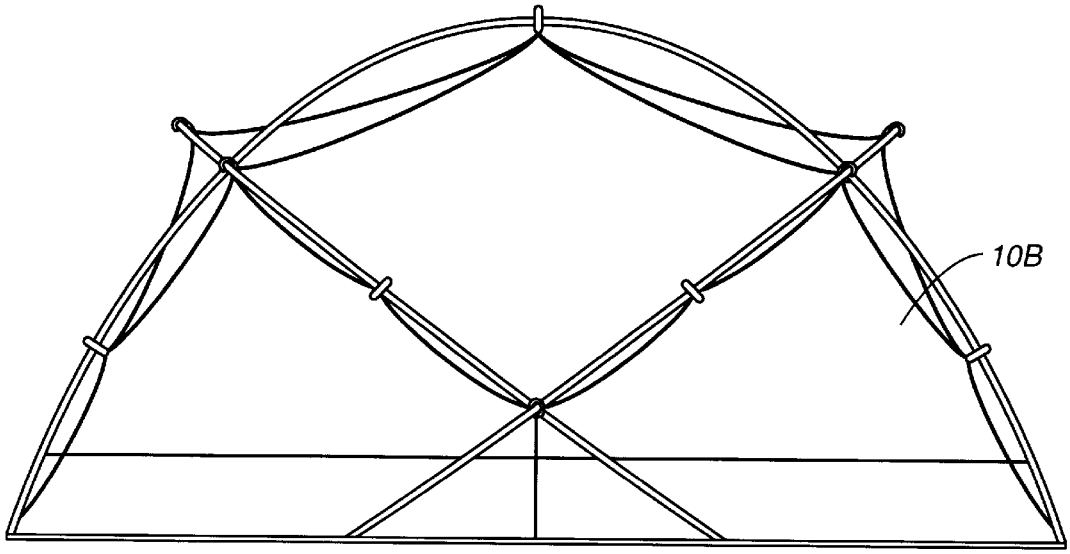
FIG. 14 is a view similar to FIG. 2 but illustrating the alternative embodiment of FIG. 13.

Referring now to FIGS. 1–6, a tent structure constructed in accordance with the teachings of the present invention includes a canopy 10 formed of fabric or other flexible sheet material. The canopy is supported by canopy support means including two flexible support rods or poles 12, 14. Support poles 12, 14 intersect each other externally of the canopy. The canopy is connected to the support poles by suitable connectors 16 which cooperate with the poles to maintain the canopy in a generally dome-shaped configuration. The tent structure includes an ingress and egress opening selectively covered by a flap or cover 18.

Tent structure as so far described is of conventional construction and such structure can lack the degree of stability one might wish under certain conditions, for example, when the tent structure is exposed to high winds. Furthermore, a conventional tent structure of the dome type does not provide much storage area. Since such tents are often relatively small and light for backpacking purposes, interior space is at a premium and an occupant of the tent is often forced to either use limited tent floor space to store items or leave them outside the tent.

By utilizing the teachings of the present invention not only is stability added to the tent structure but storage space is provided enabling the tent occupant or occupants to store articles at a location above the tent floor.

Web structure comprising a web 20 formed of nylon or other suitable flexible sheet material is disposed within the interior of the tent and is sewn or otherwise connected to the canopy along three of the four sides of the web. In the arrangement illustrated, the sides of the web attached to the canopy are designated by reference numerals 22, 24 and 26 (see FIGS. 4, 5 and 6).

Web 20, as shown, has a generally trapezoidal configuration. Attached to web 20 and extending into the interior of the tent from the web is an article storage and support member comprising a shelf 30 formed of nylon or other suitable material having an upper surface for supporting one or more articles. The end of shelf 30 attached to the web is spaced from the top of the canopy so that access readily may be had to the pouch thus created at the top of the canopy, rendering it highly convenient for use by the occupant or occupants when storing gear, provisions or other articles. The opposed side ends 32, 34 (FIG. 5) of the shelf are sewn or otherwise secured to the canopy.

The support poles 12, 14 exert outwardly directed forces on the canopy. Such forces will cause tension to be exerted on both the web 20 and the shelf 30. Such tension serves to stabilize the canopy and the support poles, creating a more rigid structure than would exist in the absence of the web and shelf. Without the internal web and tension shelf structure undesired movement of the poles could occur. In the arrangement illustrated, web 20 has a generally planar configuration while the shelf 30 is somewhat bent to define a generally catenary curve configuration at the web-shelf junction. The shelf itself is highly stable.

Additional tent structural stability results from the use of a stabilizer pole 40 located above the entry of the tent. The stabilizer pole 40 has two spaced stabilizer pole ends, one of the ends being connected to support pole 12 and the other to support pole 14. Any suitable ties or connectors may be employed to accomplish this.

In the arrangement illustrated, the stabilizer pole 40 is also connected directly to the canopy 10 by hooks or other types of connectors 16 at locations between the ends of the stabilizer pole.

The stabilizer pole 40 is bent and under tension, exerting opposed forces on the support poles 12, 14, urging or biasing them away from one another. This, in turn, increases the tension on web 20 and shelf 30 within the interior of the tent. In the arrangement illustrated, the support pole ends are generally aligned along the line of intersection between web 20 and shelf 30.

Referring now to FIGS. 7 through 12B, an alternative embodiment of the invention is illustrated. In this arrangement, canopy 10A is supported by four support poles 50, 52, 54, 56, all of which extend completely over and alongside the canopy. The ends of the support poles are supported by the ground. All four support poles intersect with at least one of the other poles and are over the canopy.

In this embodiment, one of the support poles, support pole 50, is generally aligned with a web 60 located within the interior of the tent as defined by the canopy 10A. In this embodiment the web 60 is maintained under tension by the forces exerted on the canopy by the two halves of the flexible support pole 50. In this arrangement also, web 60 extends all along the inner wall surface of the canopy from ground level to ground level. The cross-sectional dimension of the web 60 gradually decreases as the web proceeds to ground level.

Shelf 62 formed from fabric or other flexible sheet material is attached to and projects from web 60 into the tent interior. The opposed side ends of the shelf are secured directly to the canopy so that the canopy will apply opposed tensional forces to the shelf, in the manner earlier described with regard to the shelf of the first embodiment.

In addition to the pouch formed by the web 60 the shelf 62 and canopy 10A, pockets such as pockets 64A, 64B are secured to and depend from the web.

It will be appreciated that the web 60 and tensioned shelf 62 of the second embodiment shown in FIGS. 7 through 12B not only contribute to structural stability of the tent but also add significant storage space.

Figure 15:
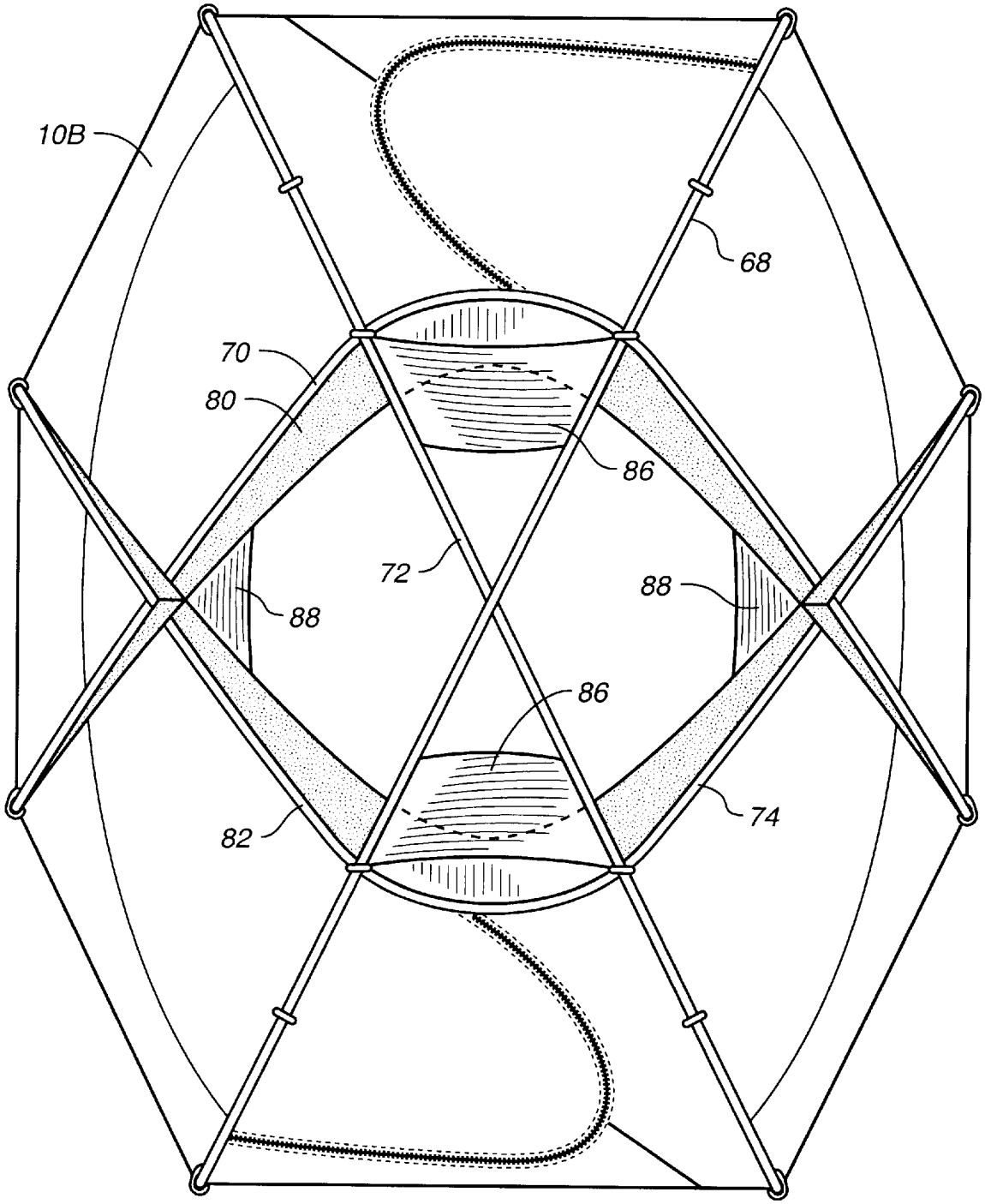
FIG. 15 is a schematic top plan view of the tent shown in FIG. 13 illustrating web structure and storage shelf structure employed therein.
Figure 16:
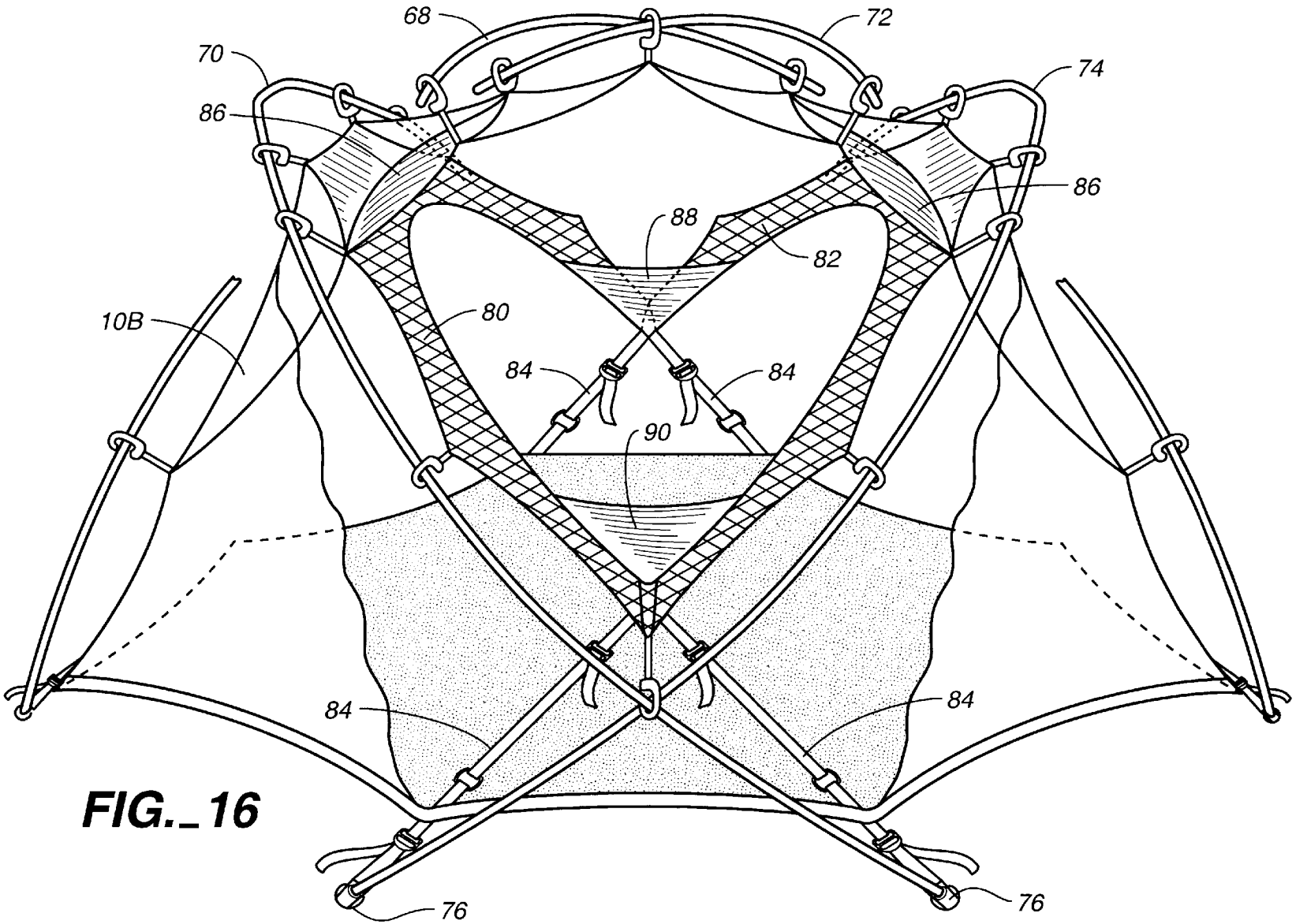
FIG. 16 is a perspective view of the tent embodiment of FIG. 13 with portions thereof broken away to illustrate selected structural details.

FIGS. 13 through 16 illustrate another embodiment of the invention. The illustrated tent structure includes a canopy 10B supported by four intersecting canopy support poles 68, 70, 72, 74 terminating at the distal ends thereof at tent anchors 76 projecting outwardly from the canopy periphery at the lower end thereof. FIG. 15 and FIG. 16 illustrate the structure inside the tent, FIG. 15 being a schematic top plan view and FIG. 16 being a perspective view with portions of the outer canopy broken away to illustrate selected structure in more detail, in particular web structure and shelf structure located within the interior of the tent canopy.

The web structure employed in this arrangement includes two web segments 80, 82 which are connected to and project inwardly from the canopy 10B. The arched web segments are disposed at an angle with respect to each other and diverge outwardly in an upward direction. Tension straps may be connected to the web structure to adjust the degree of tension applied thereto as shown in FIG. 16.

Upper shelves 86 extend inwardly into the tent interior from the upper ends of web segments 82, the respective side ends thereof being attached to the canopy as described above with respect to other embodiments of the invention. Lower shelves 88 are also provided, such lower shelves having the ends thereof secured to the web segments 80, 82 as shown rather than directly to the canopy. The tension applied to the web segments will tension the lower shelves.

Figure 17:
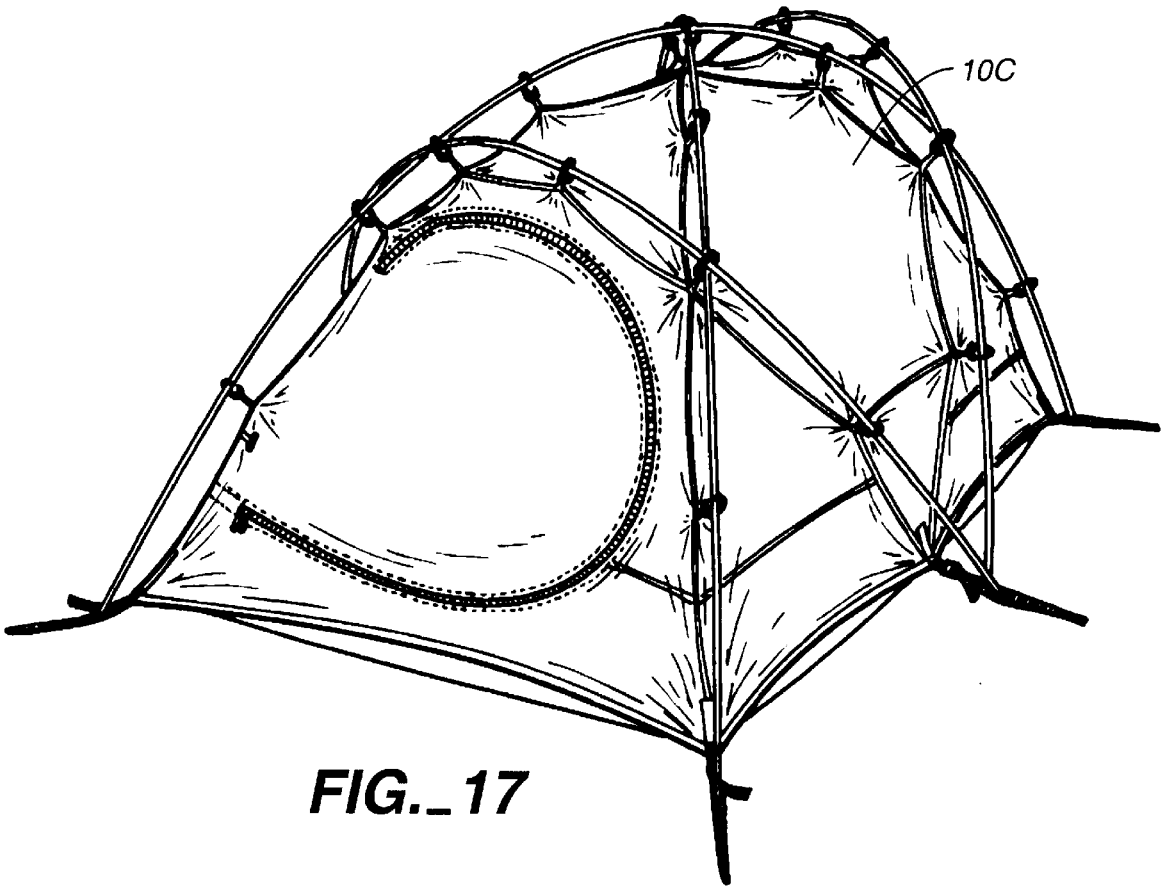
FIG. 17 is a view similar to FIG. 1, but illustrating yet another alternative embodiment of the invention.
Figure 18:
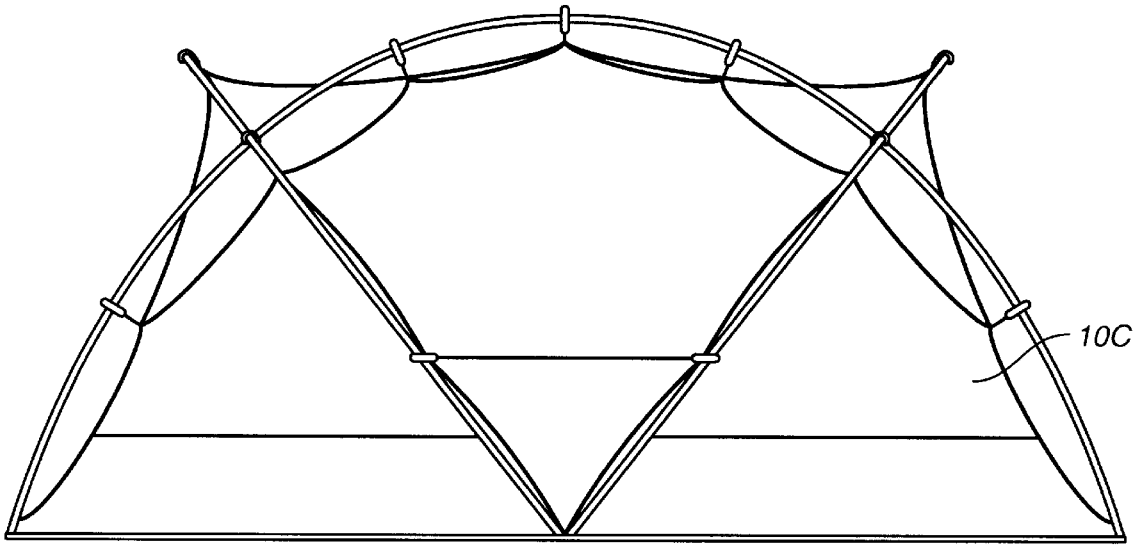
FIG. 18 is a view similar to FIG. 2, but illustrating the alternative embodiment of FIG. 17.
Figure 19:
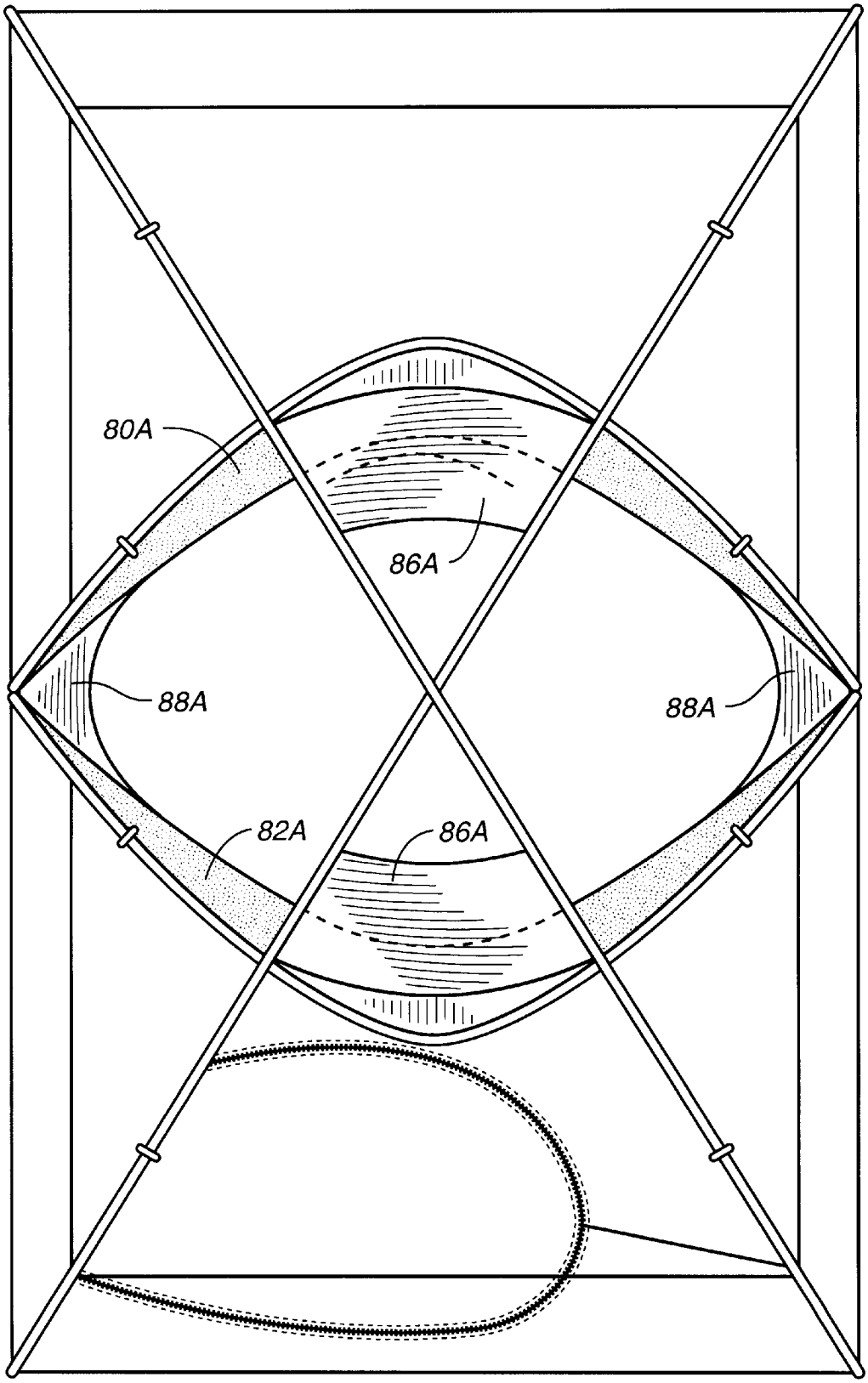
FIG. 19 is a somewhat schematic top view illustrating selective structural components of the FIG. 17 embodiment.
Figure 21:
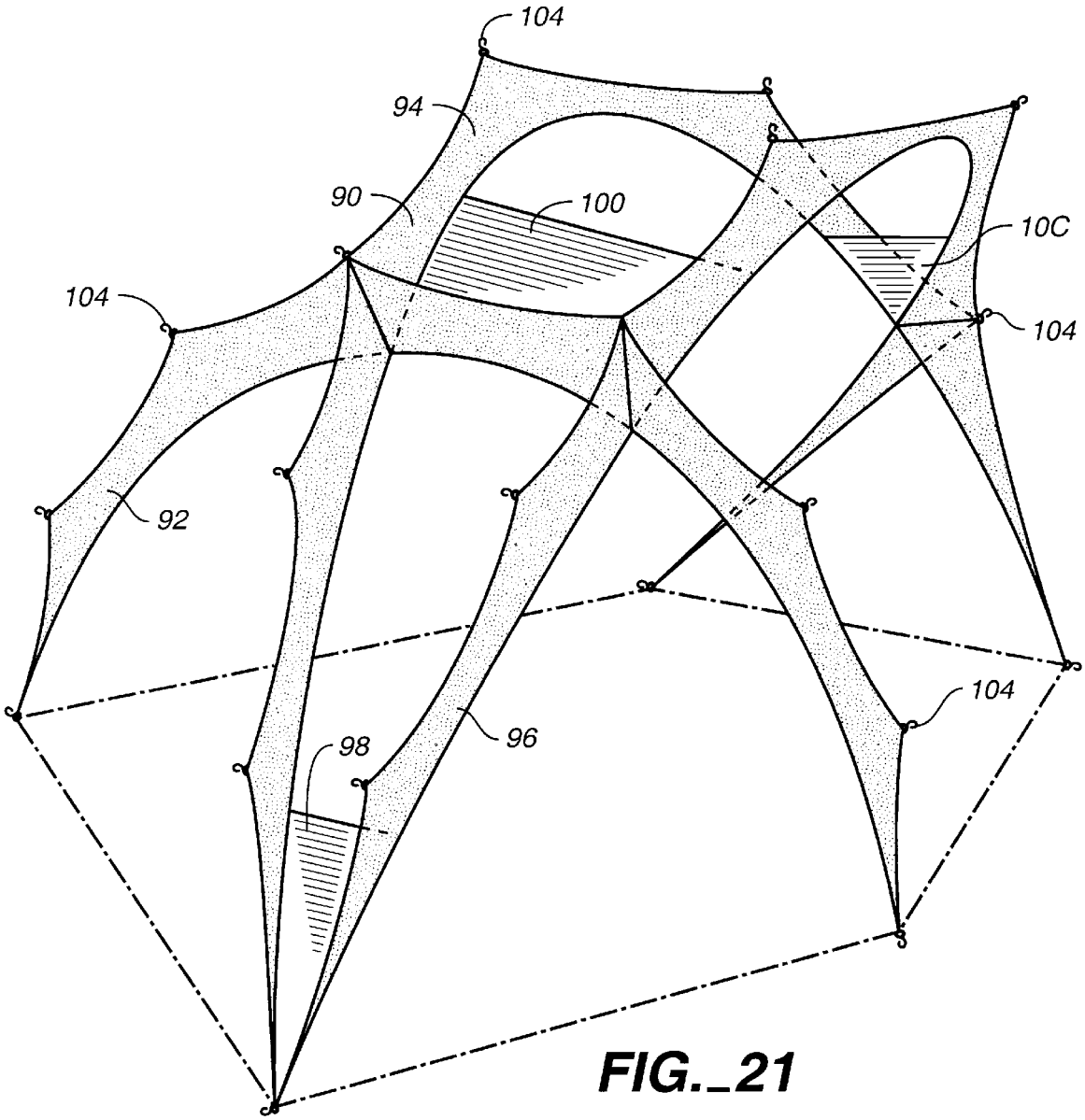
FIG. 21 is a diagrammatic perspective view illustrating web and storage shelf structure of the tent of FIG. 20.
Figure 20:
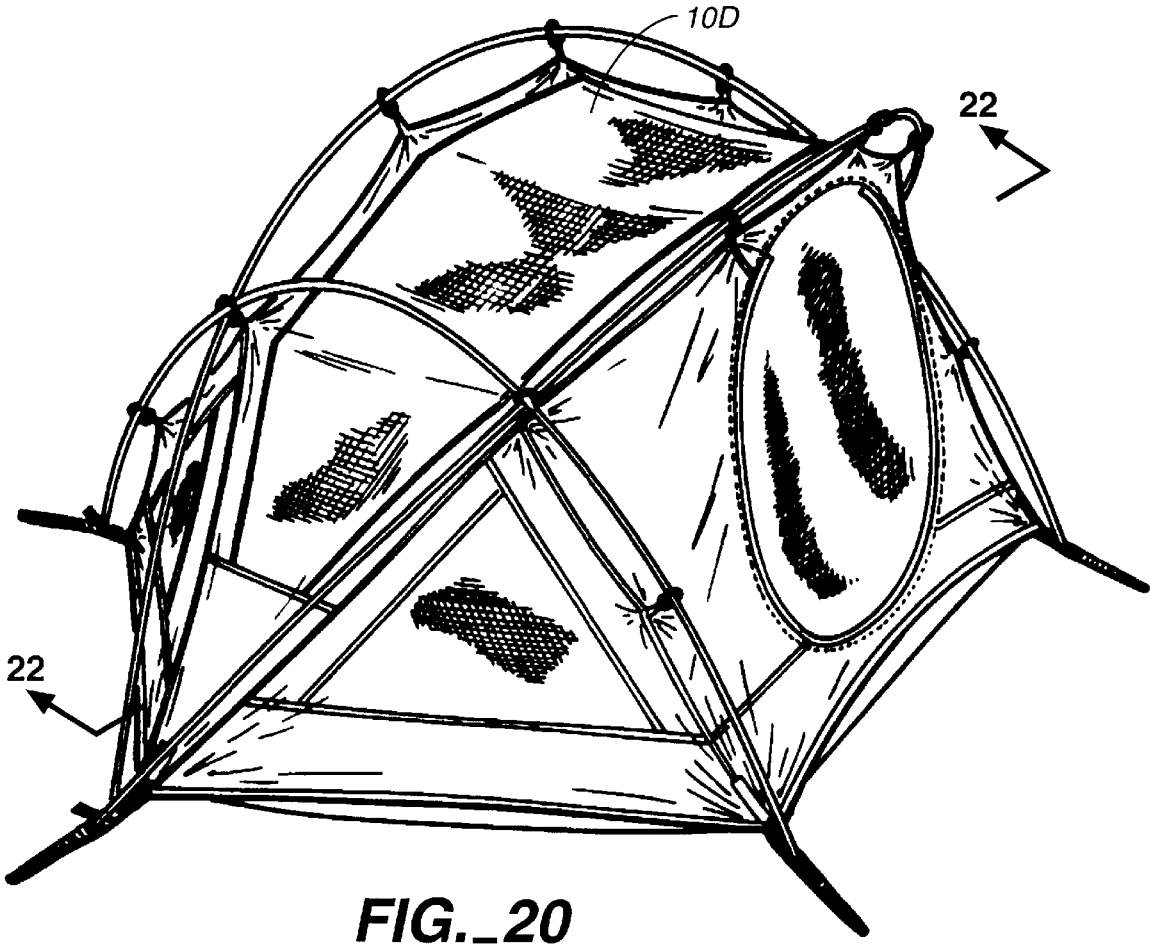
FIG. 20 is a view similar to FIG. 1, but illustrating still another alternative embodiment of the present invention.
Figure 22:
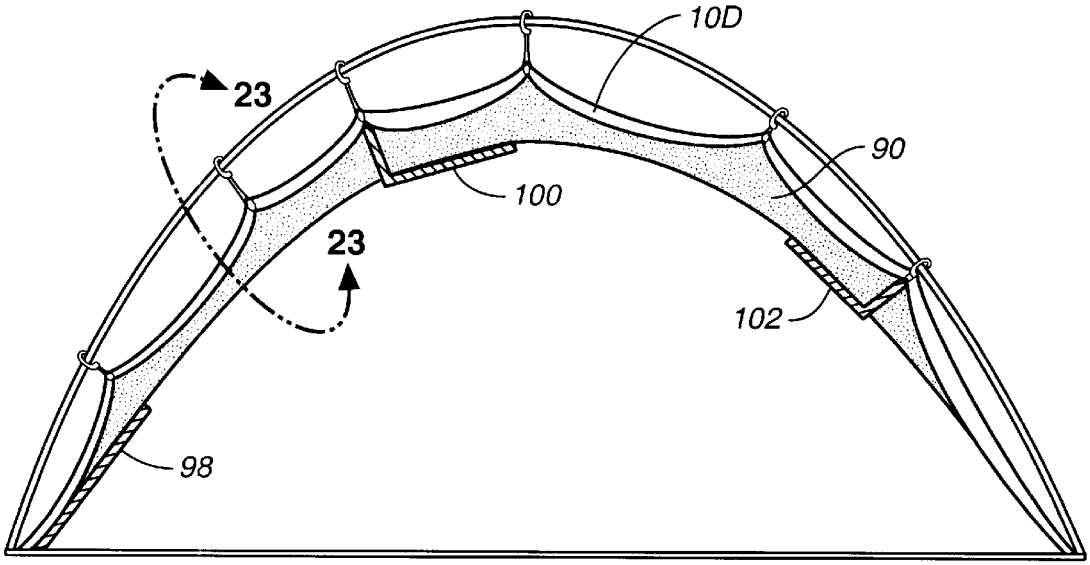
FIG. 22 is a view similar to FIG. 2, but illustrating the embodiment of FIG. 20.
Figure 23:
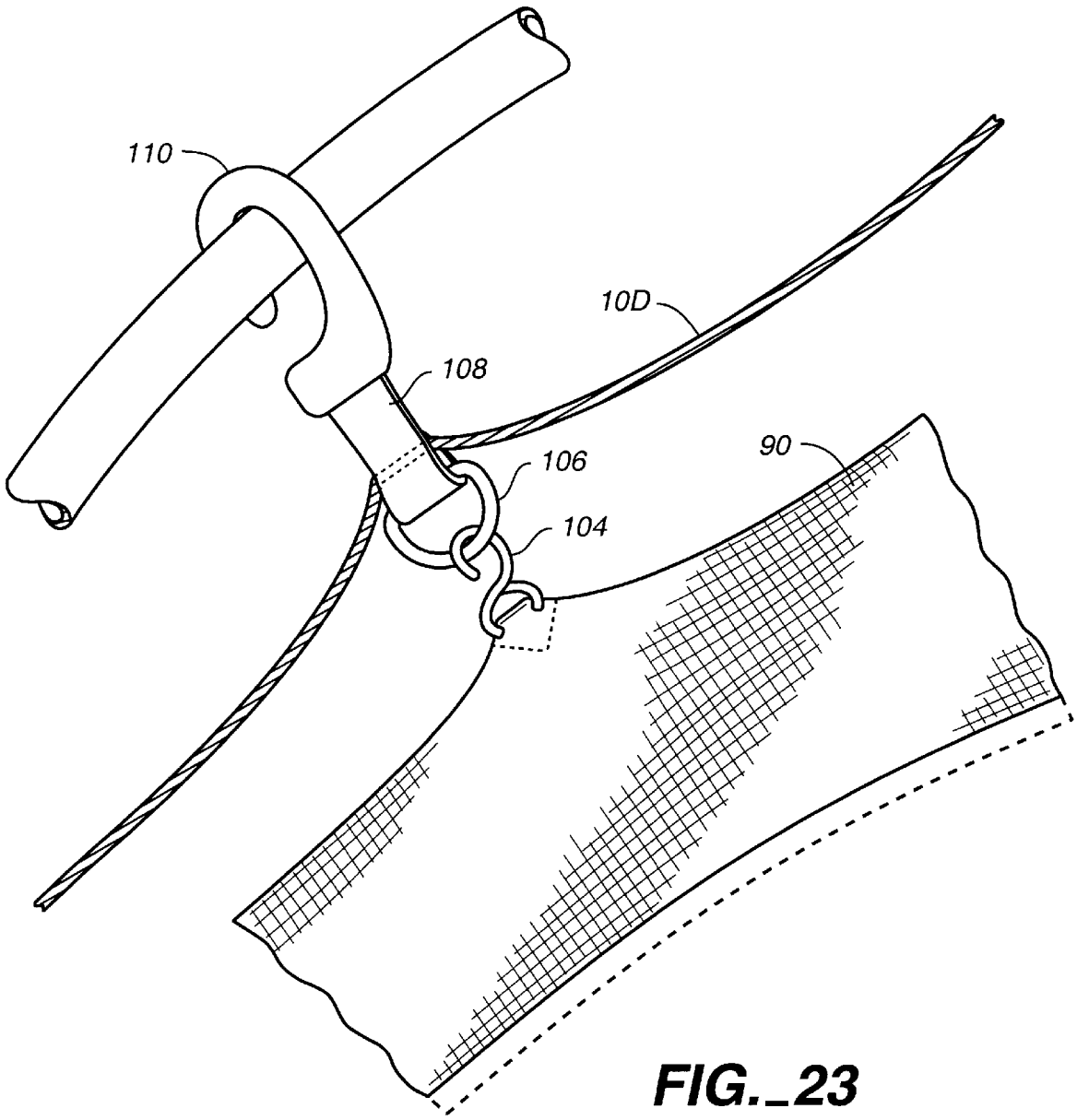
FIG. 23 is an enlarged, perspective view illustrating a portion of the tent structure as delineated by double-headed arrow 23—23 in FIG. 22.

FIGS. 17–19 illustrate yet another embodiment of the invention which includes a canopy 10C supported by a member of bent, ground engaging, flexible support poles. In this embodiment also, two upwardly and outwardly diverging web segments 80A and 82A are shown. Upper shelves 86A are secured at one side end to the web segments and at the opposed sides thereof to the canopy 10C. Lower shelves 88A are formed at the intersections of the web segments 80A, 82A and are tensioned thereby upon erection of the tent.

FIGS. 20–23 illustrate still another embodiment of a tent constructed in accordance with the teachings of the present invention. In this particular embodiment canopy 10D is also supported by a number of bent, flexible canopy support poles, such poles extending to the ground. Within the interior defined by the supported canopy is web structure 90 comprised of a plurality of web segments such as web segments 92, 94 and 96 which intersect at a plurality of intersections at angles and form a network of web segments extending about the interior of the canopy from top to bottom. Shelves such as shelves 98, 100, 102 extend between some adjacent web segments.

The entire web structure 90 and shelves supported thereby and maintained under tension thereby are releasably connected to the canopy and may be collapsed and then stored or transported as a separate unit when not in use. Hooks 104 are secured to and project from the web structure 90 at selected locations. As may perhaps best be seen with reference to FIG. 23, the hooks are engageable with rings 106 which are at the inner ends of connector straps 108 passing through the canopy 10D. The outer end of the connector strap has a connector hook 110 for engaging a support pole.

We claim:

1. Tent structure comprising, in combination:

a canopy formed of flexible sheet material;

canopy support means supporting said canopy and exerting opposed, outwardly directed forces on said canopy at spaced locations on said canopy with said canopy forming a tent interior, said canopy support means comprising at least one bent, flexible pole connected to said canopy;

web structure attached to said canopy and disposed within said tent interior, said web structure being formed of flexible sheet material and having first and second pairs of opposed web structure sides, both web structure sides of said first pair of web structure sides being in engagement with and permanently secured to said canopy, one web structure side of said second pair of web structure sides being in engagement with and permanently secured to said canopy and extending between the web structure sides of said first pair of web structure sides, and one web structure side of said second pair of web structure sides not being in engagement with said canopy, said web structure being maintained under tension by the opposed forces exerted on said canopy by said canopy support means when said canopy is supported by said canopy support means and forms a tent interior to stabilize the tent structure; and an article storage and support member comprising a shelf formed of flexible sheet material attached to said canopy and attached to said web structure within the tent interior and having a shelf surface for engagement by one or more articles in the tent interior to provide support therefor, said shelf surface being angularly disposed relative to said web structure and having first and second pairs of opposed shelf sides, both shelf sides of said first pair of shelf sides being in engagement with and permanently secured to said canopy and one shelf side of said second pair of shelf sides being attached to and extending along the length of the web structure side of said second pair of web structure sides not in engagement with said canopy, said shelf being maintained under tension by the opposed forces exerted on said canopy by said canopy support means when said canopy is supported by said canopy support means and forms a tent interior to further stabilize the tent structure.

2. The tent structure according to claim 1 wherein said at least one bent, flexible pole has two distal ends, said distal ends located on the ground at spaced locations.

3. The tent structure according to claim 1 wherein said canopy support means comprises a plurality of bent, flexible poles connected to said canopy at different locations on said canopy and exerting forces on said canopy, on said web structure and on said article storage and support member to maintain said web structure and said article storage and support member under tension.

4. The tent structure according to claim 1 wherein at least some of said bent, flexible poles intersect and wherein at least one of said bent, flexible poles has distal ends supported by the ground.

5. The tent structure according to claim 3 wherein at least some of said bent, flexible poles are secured together.

6. The tent structure according to claim 4 wherein at least one of said bent, flexible poles comprises a stabilizer pole extending between and connected at ends of said stabilizer pole to at least one other of said bent, flexible poles.

7. The tent structure according to claim 6 wherein said stabilizer pole is located substantially outside said canopy.

8. The tent structure according to claim 6 wherein said stabilizer pole ends are connected to two different bent flexible poles having spaced ends at locations spaced from said spaced ends.

9. The tent structure according to claim 6 additionally comprising connectors extending between said stabilizer pole and said canopy.

10. The tent structure according to claim 1 wherein said web structure and said canopy are of unitary construction.

11. The tent structure according to claim 1 wherein said web structure and said article storage and support member are of unitary construction.

12. The tent structure according to claim 1 wherein both web structure sides of said first pair of web structure sides are in engagement with and permanently secured to said canopy along substantially the full lengths of the web structure sides of said first pair of web structure sides.

13. The tent structure according to claim 1 wherein the web structure side of said second pair of web structure sides in engagement with said canopy is secured to said canopy along substantially the full length of the web structure side in engagement with said canopy.

14. The tent structure according to claim 1 wherein the shelf sides of said first pair of shelf sides are permanently secured to said canopy along substantially the full lengths of the shelf sides of said first pair of shelf sides.

* * * * *